US007098866B2

(12) United States Patent
Desjeux et al.

(10) Patent No.: US 7,098,866 B2
(45) Date of Patent: Aug. 29, 2006

(54) READER OR TRANSMITTER AND/OR RECEIVER COMPRISING A SHIELDED ANTENNA

(75) Inventors: Olivier Desjeux, Le Landeron (CH); Laurent Neveux, Monaco (MC)

(73) Assignee: EM Microelectonics-Marin SA, Marin (CH)

( * ) Notice: Subject to any disclaimer, the term of this patent is extended or adjusted under 35 U.S.C. 154(b) by 0 days.

(21) Appl. No.: 10/533,444

(22) PCT Filed: Oct. 31, 2002

(86) PCT No.: PCT/EP02/12195

§ 371 (c)(1),
(2), (4) Date: May 2, 2005

(87) PCT Pub. No.: WO2004/040698

PCT Pub. Date: May 13, 2004

(65) Prior Publication Data

US 2006/0044208 A1 Mar. 2, 2006

(51) Int. Cl.
*H01Q 1/36* (2006.01)

(52) U.S. Cl. ..... 343/895; 343/742; 343/867; 343/842; 343/748; 235/492

(58) Field of Classification Search ..... 343/895, 343/742, 748, 842, 867; 235/492
See application file for complete search history.

(56) References Cited

U.S. PATENT DOCUMENTS 6,137,447 A * 10/2000 Saitoh et al. ..... 343/742
6,943,680 B1 * 9/2005 Ward, Jr. ..... 340/506

FOREIGN PATENT DOCUMENTS

EP 0 440 370 A 8/1991
WO PCT WO 96/38877 A 12/1996

OTHER PUBLICATIONS

Patent Abstracts of Japan, vol. 2002, No. 03, Apr. 3, 2003 (JP 2001-326526).

International Search Report completed Jul. 25, 2003 (mailed Aug. 1, 2003) in corresponding International Appln. PCT/EP 02/12195.

* cited by examiner

*Primary Examiner*—Tho Phan
*Assistant Examiner*—Chuc Tran
(74) *Attorney, Agent, or Firm*—Griffin & Szipl, P.C.

(57) ABSTRACT

The reader or transmitter and/or receiver (22) includes a sheathed antenna formed of two groups of turns or coils (6, 8, 9; 16, 17). The first group of turns or coils forms a sheathed antenna. The second group includes two coils (16, 17) arranged between the central coil (6) and respectively the two end coils (8, 9) of the first group. The second group of coils is powered in phase quadrature relative to the first group of coils, the set of coils being arranged so as to obtain a magnetic field (H) whose amplitude (A) is approximately constant along the central axis (24) of the antenna inside the overall inner volume of the latter.

5 Claims, 5 Drawing Sheets

READER OR TRANSMITTER AND/OR RECEIVER COMPRISING A SHIELDED ANTENNA

This application is a 371 PCT/EP02/12195 Oct. 31, 2002.

The present invention concerns a reader or a transmitter and/or a receiver fitted with a shielded antenna. In particular, the invention concerns a device of this type provided for communicating with transponders placed inside a communication volume defined by the antenna, particularly by the geometrical dimensions thereof. By way of example, the communication volume is provided inside a cylinder or a parallelepiped rectangle around which the antenna is arranged.

In order to shield the antenna, particularly so that it does not disturb its environment, those skilled in the art know, in accordance with FIG. 1, to arrange a central coil 2 defining inside its turns 4 a communication volume 6 and, on either side of said coil 2, two shielding coils 8 and 9. In order not to decrease the communication volume of the antenna, coils 8 and 9 are arranged at a certain distance from coil 2. In fact, in order to cancel out the magnetic field outside the antenna, coils 8 and 9 are powered with a phase shift of 180° relative to the central communication coil. As appears in the lower graph of FIG. 1, a sharp decrease in the field amplitude of the shielded antenna occurs between the three regions dominated by the three respective fields of the three coils concerned. These magnetic field amplitude decrease regions 11 and 12 thus result from the aforementioned 180° phase shift for powering the shielding coils. It will be noted that, in regions 11 and 12, the magnetic field decrease is relatively large, such that communication between the reader or transmitter and/or receiver and transponders cannot be guaranteed in these regions. Consequently, the active zone ZA of the sheathed antenna shown in FIG. 1 is limited to inside the geometrical dimensions of coil 2. This constitutes a major drawback for such a device.

In fact, the sheathed antenna of the prior art according to FIG. 1 has a useful communication volume of relatively small length ZA in relation to the total length L of the shielded antenna.

It is an object of the present invention to overcome the aforementioned major drawback by proposing a reader or transmitter and/or receiver with a sheathed antenna whose useful communication zone substantially corresponds to the total length of the shielded antenna.

The invention therefore concerns a reader or transmitter and/or receiver for communication with transponders whose antenna is formed of several turns defining a central axis and an overall internal volume, characterized in that the antenna includes a first group of turns forming at least one first coil and a second group of turns forming at least one second coil, these first and second coils being powered in phase quadrature and arranged to generate a communication field with an approximately constant amplitude over substantially the entire length of said antenna along its central axis and decreasing rapidly outside the antenna as it moves away from the latter.

In a particular embodiment, the shielded antenna of the prior art shown in FIG. 1 is altered by incorporating two compensation coils between the central coil and respectively the two end coils, these two compensation coils being powered with a phase shift of 90° relative to the other three coils. These two compensation coils are also powered with a phase shift of 180°, so as to quickly cancel out their resulting field outside the antenna, and are arranged relative to the first three coils shown in FIG. 1 so as to compensate for the decrease in the magnetic field in regions 11 and 12, i.e. between central coil 2 and end coils 8 and 9.

The present invention will be described in more detail with reference to the annexed drawing, given by way of non-limiting example, in which:

FIG. 1, already described, shows a shielded antenna according to the prior art and the resulting amplitude of the magnetic field along its central axis;

FIG. 2 schematically shows a first embodiment of a communication reader or transmitter and/or receiver according to the invention with a graph giving the amplitude of the magnetic fields present and the resulting magnetic field;

Figure 1:
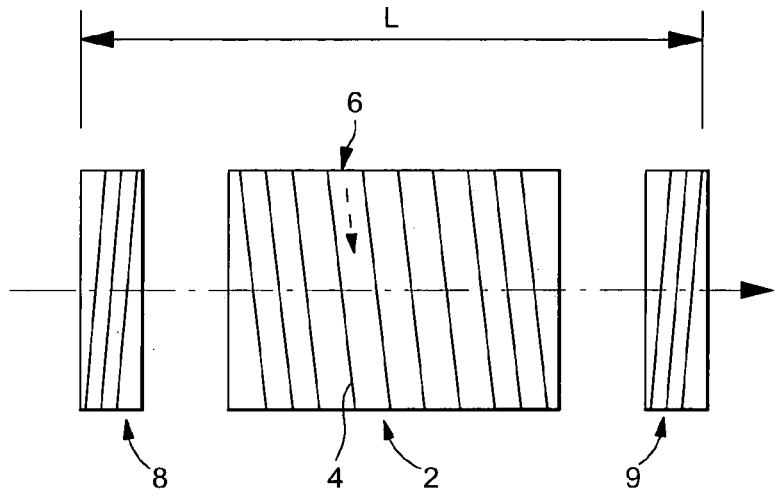
Fig.1 (Prior art)
Figure 1:
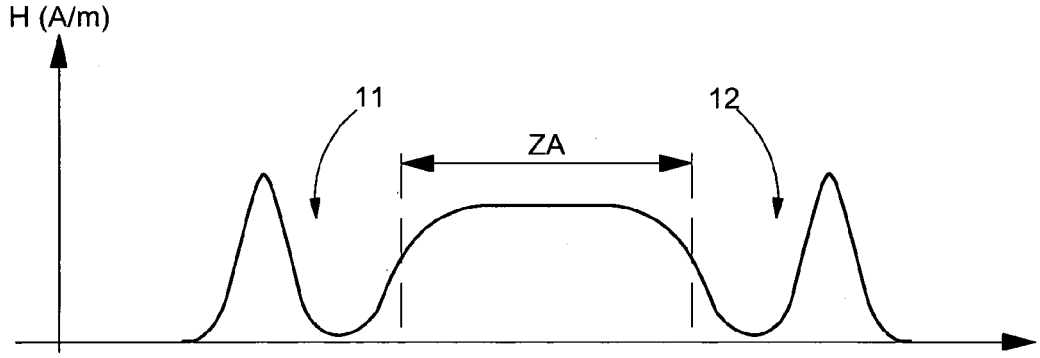
Fig.1 (Prior art)
Figure 2:
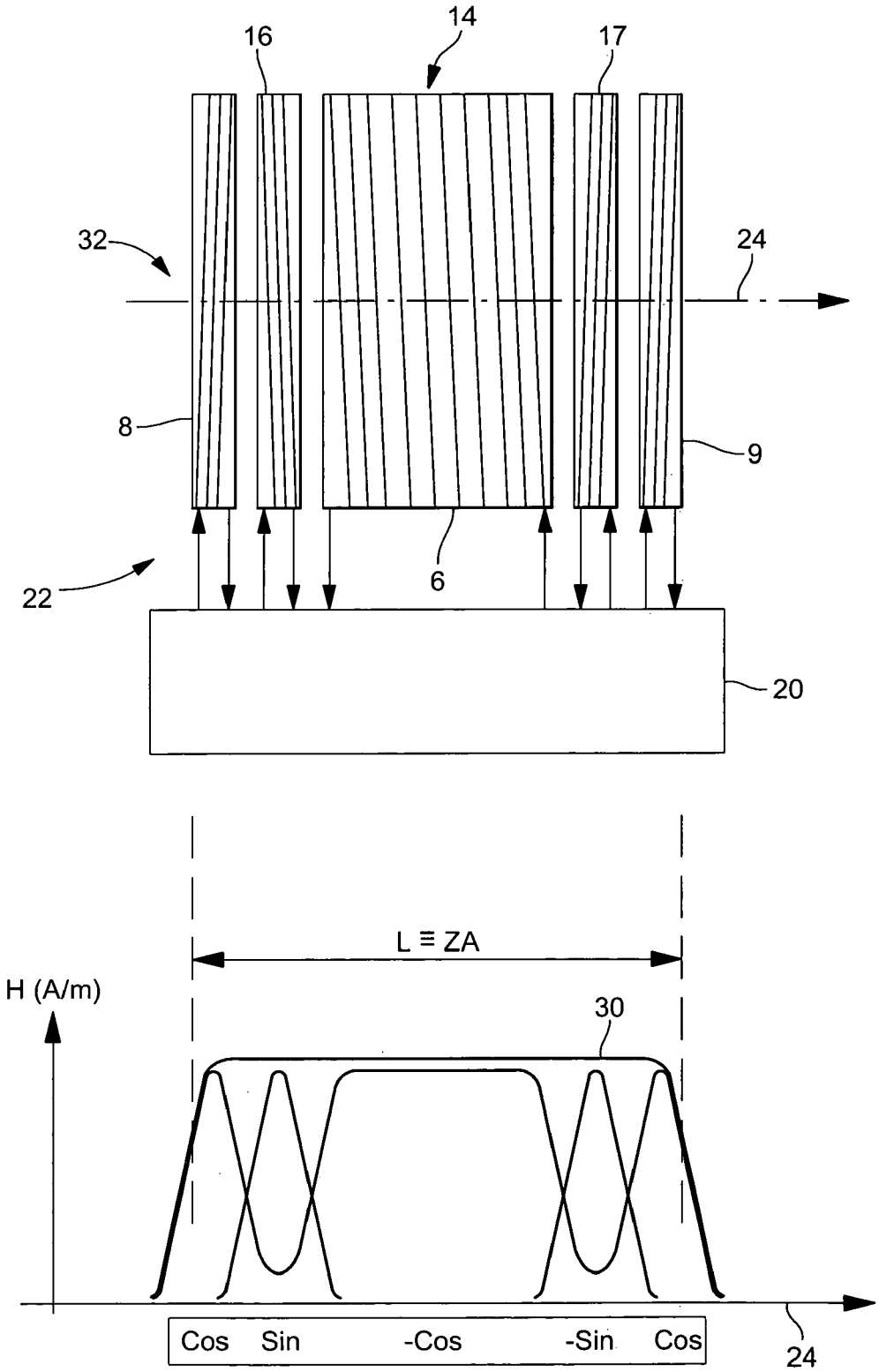
Figure 3:
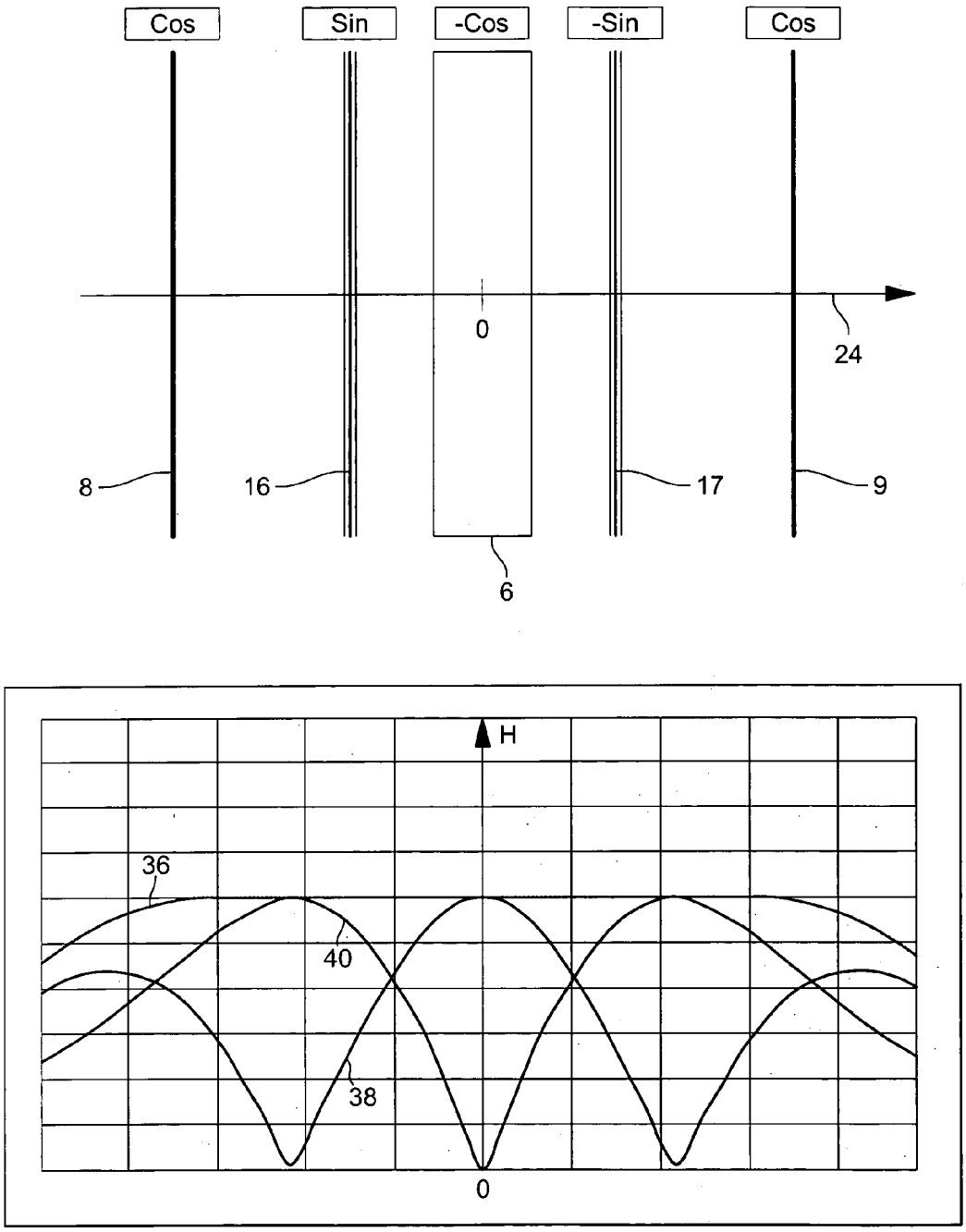
FIG. 3 shows a particular variant of the first embodiment.
Figure 4:
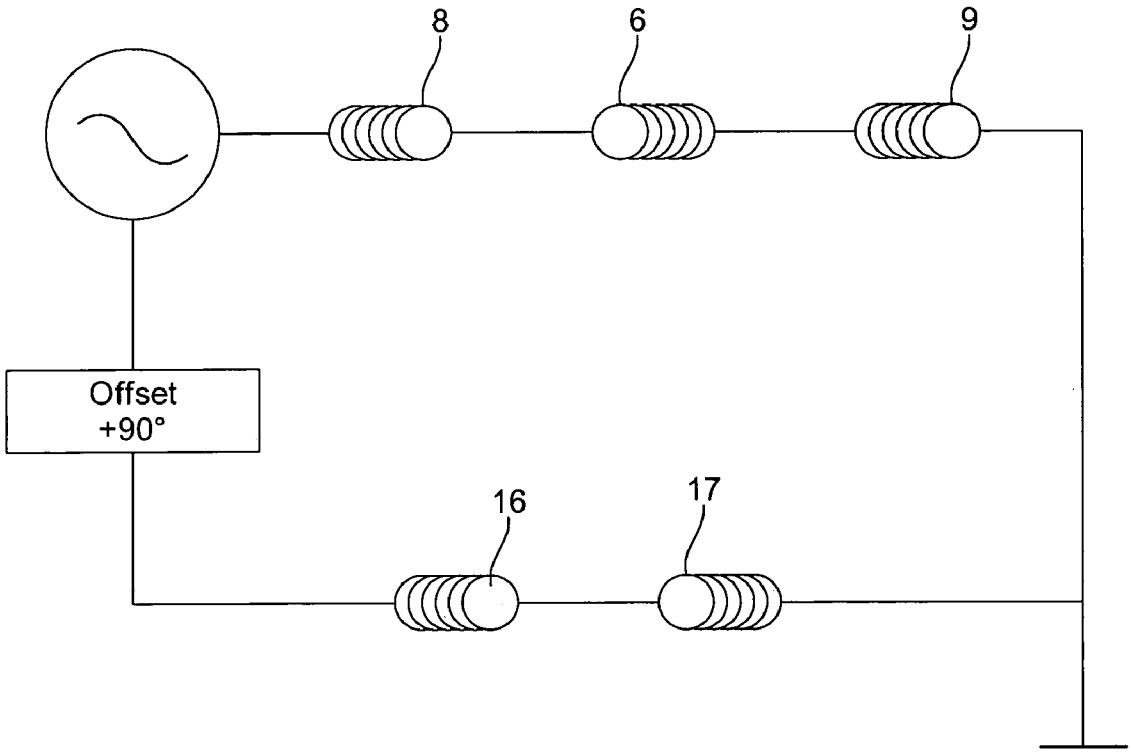
FIG. 4 shows an electric diagram of the powering of the antenna coils of the first embodiment, and FIG. 5 schematically shows a second embodiment of a reader or transmitter and/or receiver according to the invention, with a graph giving the amplitude of the magnetic fields present and the resulting magnetic field.

With reference to FIGS. 2 to 4, a first embodiment of the invention will be described hereinafter. According to the invention, between central coil 6 and the two end coils 8 and 9, two other coils 16 and 17 are arranged, powered in phase quadrature in relation to coils 6, 8 and 9. More specifically, like in FIG. 1, coils 8 and 9 are powered by the powering and control means 20 of reader 22 with a phase shift of 180° relative to central coil 6. Then, coils 16 and 17 are also powered with a phase shift of 180° in relation to the other and with a phase shift of 90° in relation to the other coils 6, 8 and 9. Finally, the two coils 16 and 17 are arranged such that their magnetic field along the central axis 24 of antenna 14 is maximum respectively in the two regions 11 and 12 where the resulting magnetic field for the three coils 6, 8 and 9 decreases or is cancelled out, as is shown in the graph of FIG. 2 which shows the amplitude of magnetic field H along central axis 24 of the antenna. The supply phase shifts are described by a cosine (Cos) and sine (Sin) supply with one of the two arithmetic signs +/− placed in front. The position of each coil along central axis 24 and the features of each coil are determined so as to obtain a relatively constant amplitude of magnetic field 30 inside volume 32 defined by the antenna, i.e. by the set of coils defining a total length L on axis 24.

Owing to the features of the invention, the shielding of the main antenna, i.e. central antenna 6, is arranged such that the overall volume defined by the set of coils provided forms the useful volume for communication with transponders. In other words, the shielding is integrated in the antenna itself. Inside each antenna there is no significant decrease in, or cancelling out of the magnetic field along active zone ZA, so that the reader according to the invention can communicate with any transponder located inside volume 32 defined by the set of coils forming the antenna. The arrangement of coils powered in phase quadrature compensates for the cancelling out of the magnetic field due to the counter-antennae powered with a phase shift of 180°. The vector sum of all the fields generated by the set of coils corresponds to a quadratic sum between the resulting field of the first group of coils 6, 8 and 9 and the resulting field of the second group of coils 16 and 17. Each coil is formed of at least one turn. Thus, the first group of coils forms a first group of turns whereas the second group of coils forms a second group of turns.

It will also be noted that the two coils 16 and 17 are powered with a phase shift of 180° so as to ensure mutual shielding outside the antenna. The electric power supply diagram of the coils is given in FIG. 4. In order to obtain the phase shift of 180° between coil 6 and coils 8 and 9, and respectively between coils 16 and 17, the turns of each coil are wound in a first direction for coils 6 and 16 and in the other direction for coils 8, 9 and 17.

FIG. 3 shows a variant of the arrangement of an antenna according to the invention. The position of the five coils 6, 8, 9, 16 and 17 is shown schematically in the top drawing. The central coil 6 includes 28 turns and extends along axis 24 between −13.5 cm and 13.5 cm. Coils 8 and 9 are each formed of 18 turns and are located respectively at −70 cm and +70 cm. When they are being powered, a current of 1 A passes through these three coils of the first group. The two coils 16 and 17 of the second group each include 15 turns and are respectively placed at −30 cm and +30 cm. The electric powering of this second group is a current of 1.57 A.

On the bottom graph giving the amplitude of the magnetic field along central axis 24, it will be observed that the total resulting field 36 is substantially constant inside the antenna over the entire distance between the two end coils 8 and 9. This graph also shows on the one hand, the amplitude of magnetic field 38 generated by the first group of coils, and on the other hand, the amplitude of magnetic field 40 generated by the second group of coils.

Figure 5:
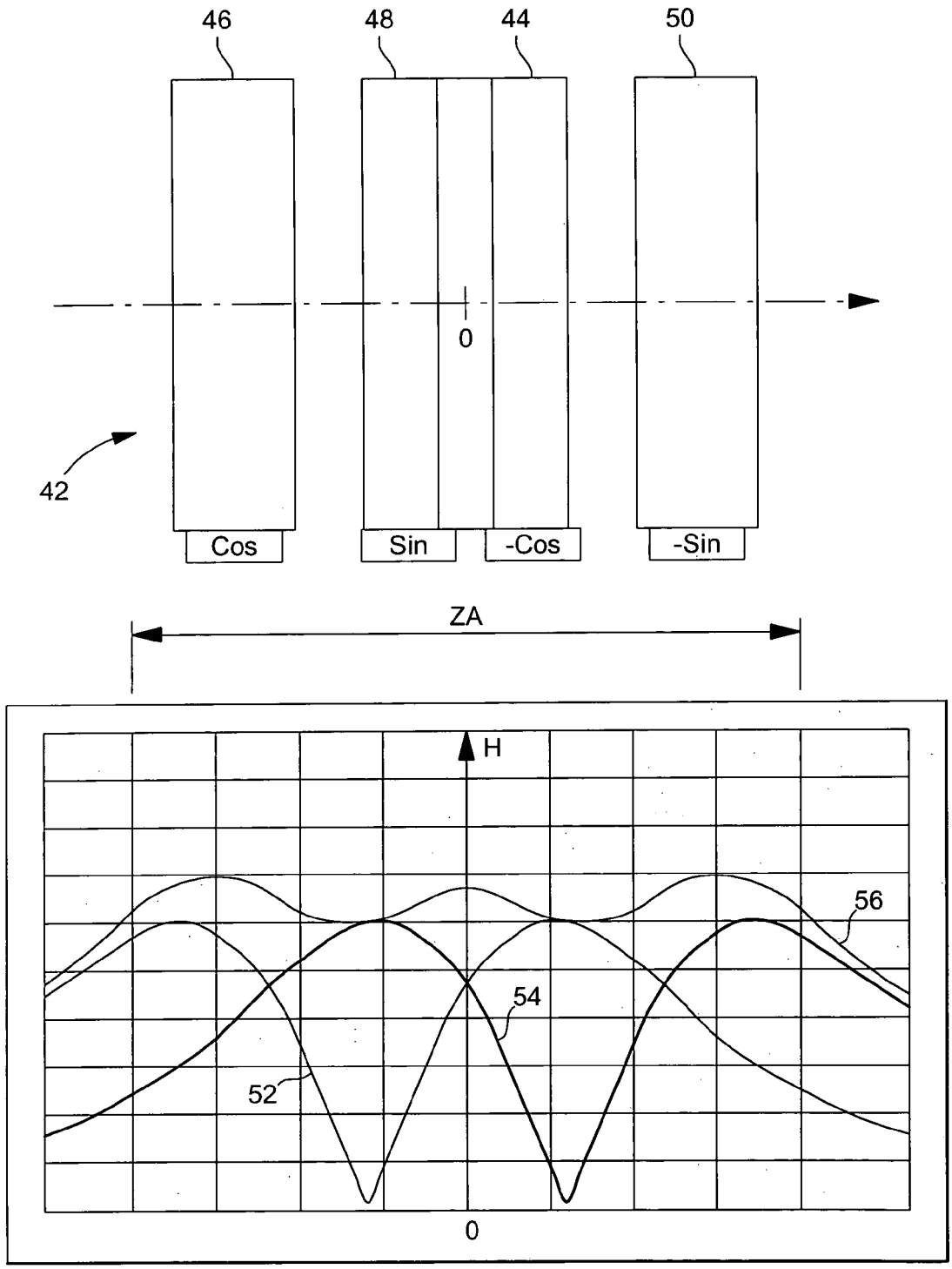

FIG. 5 shows schematically a second embodiment of the invention. In the top part of this Figure, it will be noted that only four coils form antenna 42, namely a first group formed of coils 44 and 46 and a second group formed of coils 48 and 50. The bottom graph of FIG. 5 shows amplitudes 52 and 54, respectively generated by the first and second group of coils. The total resulting magnetic field is given by curve 56, which corresponds to the quadratic sum of curves 52 and 54.

As in the first embodiment, the coils of the second group are powered in phase quadrature relative to the coils of the first group. Moreover, the two coils of the same group are powered with a phase shift of 180° so as to generate mutual shielding. The resulting amplitude 56 inside the volume defined by antenna 42 is substantially constant but has a slight variation. Thus, this second embodiment saves one coil but has to be content with a certain field variation inside the volume of the antenna, i.e. active communication zone ZA with the transponders. However, within the scope of the present invention, such a relatively small variation with respect to the amplitude of magnetic field H can be considered substantially constant.

By way of example, antenna 42 is arranged in the following manner: coil 46 extends from −70 cm to −39 cm and coil 44 extends from −22 cm to 9 cm. Coil 48 extends from −9 cm to 22 cm and coil 50 extends from 39 cm to 70 cm. All of the coils are formed of 15 turns and are powered by an electric current of 1 A. The amplitude curves given in the graph correspond to this numerical example.

Of course, those skilled in the art could optimise the arrangement of the reader according to the invention, in particular of the coils of its antenna to obtain the best result sought by the present invention, namely a substantially constant field inside the geometrical volume of the antenna so as to allow efficient communication between the transponders placed inside the latter.

What is claimed is:

1. A reader or transmitter and/or receiver for communication with transponders and including an antenna formed of a plurality of turns defining a central axis and an overall inner volume, wherein said antenna includes a first group of turns forming at least one first coil and a second group of turns forming at least one second coil, said first and second groups of turns being powered in phase quadrature and arranged so as to generate a total magnetic field with an approximately constant amplitude over substantially the entire length (L) of said antenna along its central axis and decreasing rapidly outside said antenna as it moves away from the latter.

2. The reader or transmitter and/or receiver according to claim 1, wherein said first group of turns is formed of three coils comprising one central coil and two end coils respectively placed at the two ends of the antenna, said central coil being powered with a phase shift of 180° relative to the two end coils, wherein said second group of turns is formed of two compensation coils arranged between said central coil and respectively the two end coils, so as to compensate for the decrease in, or cancelling out of the magnetic field between the central coil and the two end coils used for shielding said central coil, the two compensation coils being powered with a phase shift of 180°.

3. The reader or transmitter and/or receiver according to claim 1, wherein said first group of turns if formed of two coils powered with a phase shift of 180° and in that said second group of turns is formed of two coils also powered with a phase shift of 180°, the two coils of the first group being placed at a certain distance from each other, the distance being substantially equal to that separating the two coils of said second group, said first and second groups being positioned relative to each other such that each of said groups compensates for the decrease in, or cancelling out of the magnetic field between the two coils of the other group.

4. The reader or transmitter and/or receiver according to claim 2, wherein the first group of turns is powered with an electric current of a lower value than that of the current flowing in the second group of turns, the number of turns of each coil being provided such that said total magnetic field is substantially constant inside said overall inner volume of the antenna.

5. The reader or transmitter and/or receiver according to claim 3, wherein one coil of the first group of turns is partially superposed onto one coil of the second group of turns.

* * * * *